US008647238B2

(12) United States Patent
Lepore

(10) Patent No.: US 8,647,238 B2
(45) Date of Patent: Feb. 11, 2014

(54) IMPACT ABSORBING EXERCISE DEVICE

(76) Inventor: Marianne M. Lepore, Framingham, MA (US)

( * ) Notice: Subject to any disclaimer, the term of this patent is extended or adjusted under 35 U.S.C. 154(b) by 379 days.

(21) Appl. No.: 12/761,844

(22) Filed: Apr. 16, 2010

(65) Prior Publication Data

US 2011/0256987 A1 Oct. 20, 2011

(51) Int. Cl.
*A63B 22/04* (2006.01)

(52) U.S. Cl.
USPC ..... 482/52; 482/142

(58) Field of Classification Search
USPC ..... 482/51, 52, 23, 148, 35–36, 142
See application file for complete search history.

(56) References Cited

U.S. PATENT DOCUMENTS

| | | | | | |
|---|---|---|---|---|---|
| 2,172,609 | A * | 9/1939 | Williams | 27/12 |
| 2,611,417 | A * | 9/1952 | Henry et al. | 280/30 |
| 2,831,687 | A * | 4/1958 | Hunter | 482/145 |
| 3,087,442 | A * | 4/1963 | Berliner | 108/19 |
| 4,106,413 | A * | 8/1978 | Hoaglund | 108/12 |
| 4,609,192 | A * | 9/1986 | Bratcher | 482/142 |
| 4,984,785 | A * | 1/1991 | Wilkinson | 482/52 |
| 4,993,706 | A * | 2/1991 | Wilkinson | 482/142 |
| 5,127,647 | A * | 7/1992 | Wilkinson | 482/52 |
| 5,277,675 | A * | 1/1994 | Shifferaw | 482/30 |
| 5,637,059 | A * | 6/1997 | Dalebout | 482/52 |
| 5,769,767 | A * | 6/1998 | Hochberg et al. | 482/142 |
| 5,842,955 | A * | 12/1998 | Wilkinson | 482/52 |
| 5,855,536 | A * | 1/1999 | Wilkinson | 482/52 |
| 6,132,338 | A * | 10/2000 | Shifferaw | 482/30 |
| 6,173,660 | B1 * | 1/2001 | Emmert | 108/90 |
| 6,238,320 | B1 * | 5/2001 | Flanagan | 482/41 |
| 6,652,432 | B2 * | 11/2003 | Smith | 482/146 |
| 7,007,771 | B2 * | 3/2006 | Rawlings et al. | 182/33 |
| 7,361,123 | B1 * | 4/2008 | Krull | 482/52 |
| 7,713,182 | B2 * | 5/2010 | Bizzell et al. | 482/142 |
| 2004/0082441 | A1 | 4/2004 | Kastelic | |
| 2004/0121888 | A1 | 6/2004 | Williams | |
| 2005/0148449 | A1 * | 7/2005 | Weir et al. | 482/142 |
| 2006/0217249 | A1 * | 9/2006 | Webber | 482/142 |
| 2007/0087902 | A1 | 4/2007 | Penat et al. | |
| 2008/0076641 | A1 * | 3/2008 | Sheehan | 482/92 |
| 2009/0276957 | A1 | 11/2009 | Boitet-Ball | |

FOREIGN PATENT DOCUMENTS

WO 2009/042255 A1 4/2009

OTHER PUBLICATIONS

International Search Report and Written Opinion, mailed Jul. 7, 2011, received in International Patent Application No. PCT/US2011/032651, 8 pgs.

The Reebok 5 Step—Aerobic Step, http://www.sportsunlimitedinc.com/reebok5step.html?CID=shopping, 2 pgs.

(Continued)

*Primary Examiner* — Stephen Crow

(74) *Attorney, Agent, or Firm* — Brian J. Colandreo; Nash M. Zogaib; Holland & Knight

(57) ABSTRACT

An impact absorbing exercise device includes a stepping platform having an upper surface and a lower surface. An impact absorbing panel is configured to be releasably coupled to the upper surface of the stepping platform. The impact absorbing panel includes a resilient wear surface and an impact absorbing material positioned between the resilient wear surface and the stepping platform.

10 Claims, 7 Drawing Sheets

(56) References Cited

OTHER PUBLICATIONS

Mat for Aerobic Step Platforms, shttp://www.achievefitness.org/store/mat-for-aerobic-step-platforms.html?cvsfa=2056&cvsfe=2&cvsfhu=70732d3931313138, 1 pg.

http://www99.shopping.com/xDN-sport__and__outdoor--personal__fitness-step__aerobics, 4 pgs.

International Preliminary Report on Patentability received in International Application No. PCT/US2011/032651 mailed Oct. 26, 2012 (7 pgs.).

* cited by examiner

IMPACT ABSORBING EXERCISE DEVICE

TECHNICAL FIELD

This disclosure relates to exercise devices and, more particularly, to impact absorbing exercise devices.

BACKGROUND

The benefits of aerobic exercise are undeniable, as it allows people to burn calories, stay in shape, and increase mobility. One popular type of aerobic exercise is step aerobics, in which the user repeatedly steps up onto and steps off of an exercise step.

This consistent and repetitive climbing onto the exercise step results in a vigorous workout. Unfortunately, the repeated impacts that occur when using an exercise step may cause joint discomfort, especially e.g., for older users, users with compromised joints, and users that are rehabilitating after various medical procedures/maladies.

SUMMARY OF DISCLOSURE

In one implementation, an impact absorbing exercise device includes a stepping platform having an upper surface and a lower surface. An impact absorbing panel is configured to be releasably coupled to the upper surface of the stepping platform. The impact absorbing panel includes a resilient wear surface and an impact absorbing material positioned between the resilient wear surface and the stepping platform.

One or more of the following features may be included. One or more riser assemblies may be releasably coupleable to the stepping platform and may be configured to elevate the stepping platform above a work surface.

The resilient wear surface may be constructed of a material chosen from the group consisting of: polypropylene, polyethylene, polyvinyl chloride, polycarbonate, acrylic, and acrylonitrile-butadiene-styrene. The impact absorbing material may be a silicone-based impact absorbing gel. The impact absorbing material may be an impact absorbing foam. The stepping platform may be constructed of a material chosen from the group consisting of: polypropylene, polyethylene, polyvinyl chloride, polycarbonate, acrylic, and acrylonitrile-butadiene- styrene.

A releasable attachment system may be configured to releasably attach the impact absorbing panel to the upper surface of the stepping platform. The releasable attachment system may include one or more pin assemblies configured to releasably attach the impact absorbing panel to the upper surface of the stepping platform. The releasable attachment system may include one or more latch assemblies configured to releasably attach the impact absorbing panel to the upper surface of the stepping platform. The releasable attachment system may include one or more bracket assemblies configured to releasably attach the impact absorbing panel to the upper surface of the stepping platform.

In another implementation, an impact absorbing exercise device includes a stepping platform having an upper surface and a lower surface. One or more riser assemblies are releasably coupleable to the stepping platform and configured to elevate the stepping platform above a work surface. An impact absorbing panel is configured to be releasably coupled to the upper surface of the stepping platform. The impact absorbing panel includes a resilient wear surface and an impact absorbing material positioned between the resilient wear surface and the stepping platform.

One or more of the following features may be included. The resilient wear surface may be constructed of a material chosen from the group consisting of: polypropylene, polyethylene, polyvinyl chloride, polycarbonate, acrylic, and acrylonitrile-butadiene-styrene. The impact absorbing material may be a silicone-based impact absorbing gel. The impact absorbing material may be an impact absorbing foam. The stepping platform may be constructed of a material chosen from the group consisting of: polypropylene, polyethylene, polyvinyl chloride, polycarbonate, acrylic, and acrylonitrile-butadiene-styrene.

In another implementation, an impact absorbing exercise device includes a stepping platform having an upper surface and a lower surface. An impact absorbing panel is configured to be releasably coupled to the upper surface of the stepping platform. The impact absorbing panel includes a resilient wear surface and an impact absorbing material positioned between the resilient wear surface and the stepping platform. A releasable attachment system releasably attaches the impact absorbing panel to the upper surface of the stepping platform.

One or more of the following features may be included. The releasable attachment system may include one or more of the following: one or more pin assemblies configured to releasably attach the impact absorbing panel to the upper surface of the stepping platform; one or more latch assemblies configured to releasably attach the impact absorbing panel to the upper surface of the stepping platform; and one or more bracket assemblies configured to releasably attach the impact absorbing panel to the upper surface of the stepping platform.

The resilient wear surface may be constructed of a material chosen from the group consisting of: polypropylene, polyethylene, polyvinyl chloride, polycarbonate, acrylic, and acrylonitrile-butadiene-styrene; and the stepping platform is constructed of a material chosen from the group consisting of: polypropylene, polyethylene, polyvinyl chloride, polycarbonate, acrylic, and acrylonitrile-butadiene-styrene. The impact absorbing material may be a silicone-based impact absorbing gel. The impact absorbing material may be an impact absorbing foam.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF THE PREFERRED EMBODIMENTS

Figure 1:
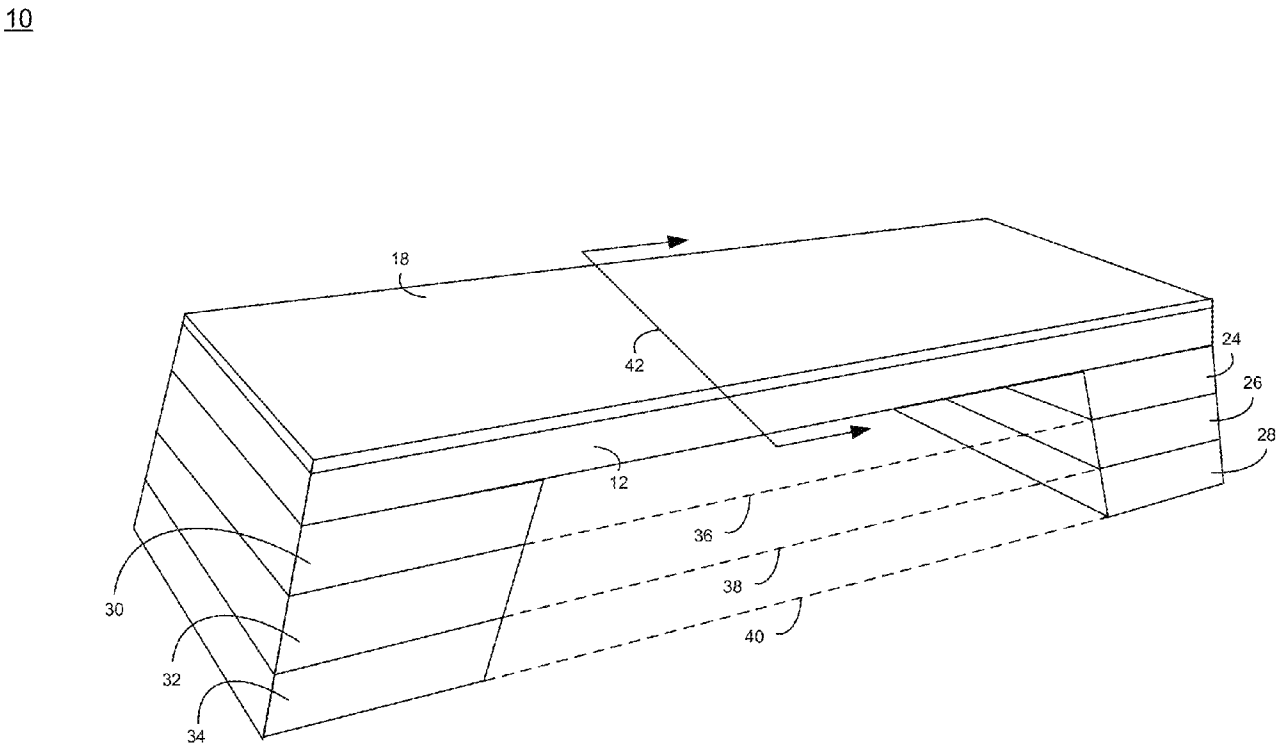
FIG. 1 is a perspective view of an impact absorbing exercise device.
Figure 2:
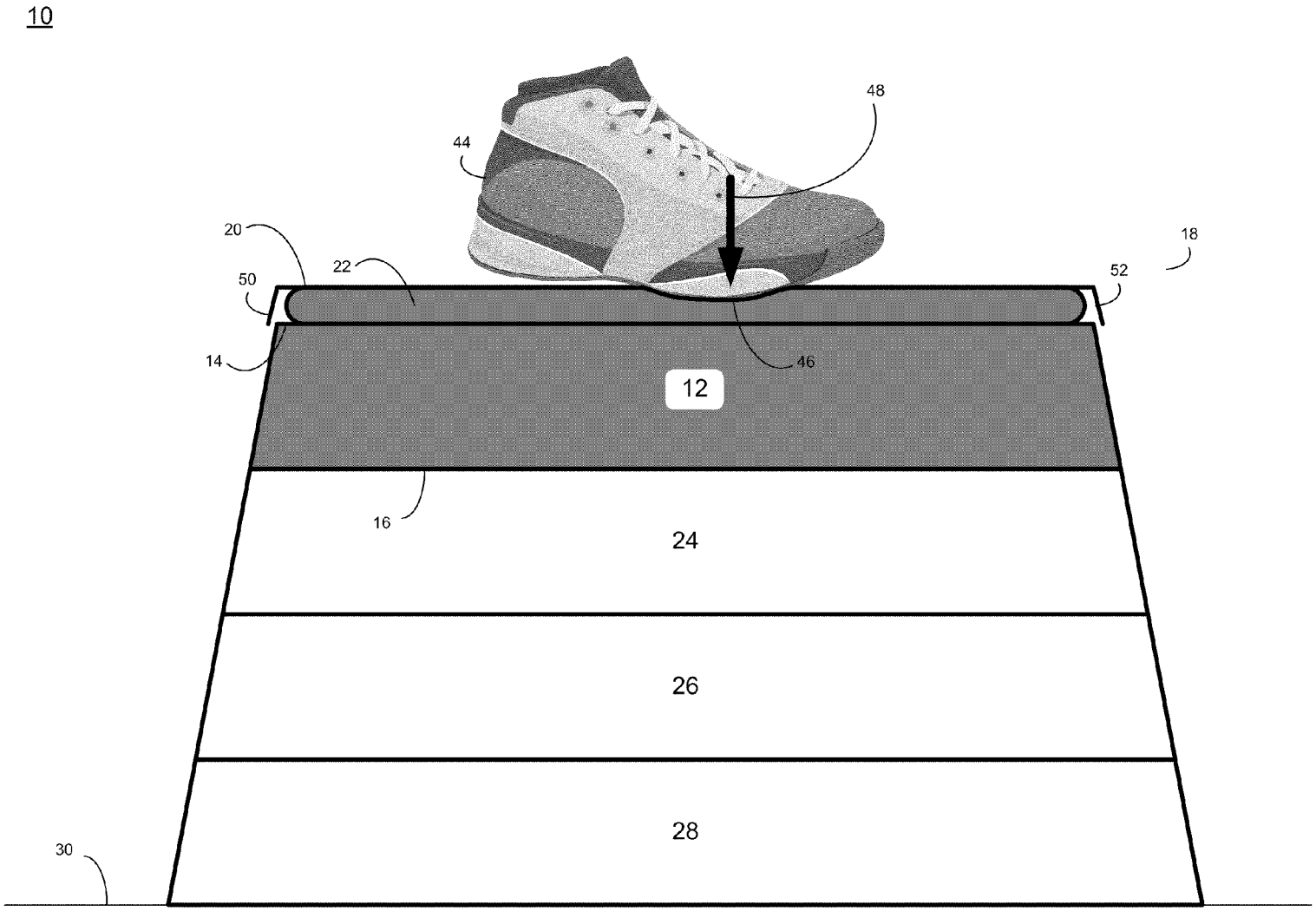
FIG. 2 is a cross-sectional view of the impact absorbing exercise device of FIG. 1.

Referring to FIGS. 1-2, there is shown impact absorbing exercise device 10 which may include stepping platform 12 having upper surface 14 and a lower surface 16. Impact absorbing panel 18 may be configured to be releasably coupled to upper surface 14 of stepping platform 12. Impact absorbing panel 18 may include resilient wear surface 20 and impact absorbing material 22 positioned between resilient wear surface 20 and stepping platform 12. One or more riser assemblies 24, 26, 28, 30, 32, 34 may be releasably coupleable to stepping platform 12 and may be configured to elevate stepping platform 12 above work surface 30 (e.g., a floor). Riser assemblies 24, 26, 28, 30, 32, 34 may include coupling devices (e.g., one or more alignment pins; not shown) that allow for the alignment and releasable coupling of e.g., riser assembly 28 to riser assembly 26; riser assembly 26 to riser assembly 24; riser assembly 24 to stepping platform 12; riser assembly 34 to riser assembly 32; riser assembly 32 to riser assembly 30, and riser assembly 30 to stepping platform 12.

While three levels of riser assemblies (e.g., the combinations of riser assemblies 24 & 30, 26 & 32, 28 & 34) are shown, this is for illustrative purposes only and is not intended to be a limitation of this disclosure, as other configurations are possible and are considered to be within the scope of this disclosure. For example, additional riser assembly levels (not shown) may be added to further increase the overall height of impact absorbing exercise device 10 with respect to work surface 30.

While in this particular example, riser assembly levels (e.g., the combinations of riser assemblies 24 & 30, 26 & 32, 28 & 34) are each shown to include two discrete riser assemblies, this is for illustrative purposes only and is not intended to be a limitation of this disclosure, as other configurations are possible and are considered to be within the scope of this disclosure. For example, a full-width riser assembly (shown with phantom lines 36, 38, 40) may be utilized.

While stepping platform 12 and impact absorbing panel 18 of FIG. 2 are shown in a crosshatch fill pattern, this is to illustrate that FIG. 2 is a cross-sectional view of impact absorbing exercise device 10 taken along section line 42 of FIG. 1.

The various components of impact absorbing exercise device 10, including but not limited to stepping platform 12 and riser assemblies 24 & 30, 26 & 32, 28 & 34 may be constructed of various materials that provide the appropriate level of strength and structural integrity. Examples of such materials may include but are not limited to polypropylene, polyethylene, polyvinyl chloride, polycarbonate, acrylic, and acrylonitrile-butadiene-styrene. While this list is intended to be illustrative, it is not intended to be all inclusive. Accordingly, other materials (e.g., wood, metal, and composites) are considered to be within the scope of this disclosure.

Resilient wear surface 20 may be constructed of various material that provide the desired level of wear resistance and flexibility/deformability. Examples of such materials may include but are not limited to polypropylene, polyethylene, polyvinyl chloride, polycarbonate, acrylic, and acrylonitrile-butadiene-styrene. While this list is intended to be illustrative, it is not intended to be all inclusive. Accordingly, other materials (e.g., wood, metal, and composites) are considered to be within the scope of this disclosure.

Specifically, resilient wear surface 20 may be sufficiently stiff to prevent impact absorbing material 22 from being damaged and/or overly compressed during use by user 44, while still providing a level of flexibility to allow for a desired level of deformation (as illustrated by deformation line 46) to effectuate the desired level of localized impact absorption. For example, any impact (e.g., impact 48) borne by resilient wear surface 20 will result in a certain level of impact absorption, as impact absorbing material 22 will at least partially compress and absorb at least a portion of the energy of impact 48. However, as the level of deformation of resilient wear surface 20 increases, impact 48 is borne by a smaller portion of impact absorbing material 22, thus allowing for a higher level of compression of impact absorbing material 22 and, thus, a higher level of impact absorption. Conversely, as the level of deformation of resilient wear surface 20 decreases, impact 48 is borne by a larger portion of impact absorbing material 22, thus allowing for a lower level of compression of impact absorbing material 22 and, thus, a lower level of impact absorption.

While resilient wear surface 20 is shown to substantially deform (as illustrated by deformation line 46) in response to impact 48, this is for illustrative purposes only and is not intended to be a limitation of this disclosure, as other configurations are possible and are considered to be within the scope of this disclosure. For example, resilient wear surface 20 may be configured so that resilient wear surface 20 provides minimal (or zero) deformation. As discussed above, any impact (e.g., impact 48) borne by resilient wear surface 20 will result in a certain level of impact absorption, as impact absorbing material 22 will at least partially compress and absorb at least a portion of the energy of impact 48. Accordingly, even if resilient wear surface 20 is substantially rigid (and, thus non-deformable), impact absorbing material 22 will at least partially compress and absorb at least a portion of the energy of impact 48

Impact absorbing material 22 may be one of many energy absorbing materials. Examples of such materials may include but are not limited to impact absorbing foam (e.g., polyurethane foam and polypropylene form) and silicone-based impact absorbing gel. While this list is intended to be illustrative, it is not intended to be all inclusive. Accordingly, other materials are considered to be within the scope of this disclosure.

The level of rigidity/viscosity of impact absorbing material 22 may be configured to allow for the appropriate level of impact absorption when paired with resilient wear surface 20. For example, a more rigid resilient wear surface may require a less rigid/viscous impact absorbing material. Conversely, a less rigid resilient wear surface may require a more rigid/viscous impact absorbing material. Resilient wear surface 20 may include one or more wing assemblies (e.g., wing assemblies 50, 52) that are configured to cover/protect the sides of impact absorbing material 22 from damage via contact by user 44.

A releasable attachment system (to be discussed below in greater detail) may be configured to releasably attach impact absorbing panel 18 to upper surface 14 of stepping platform 12.

Figure 3:
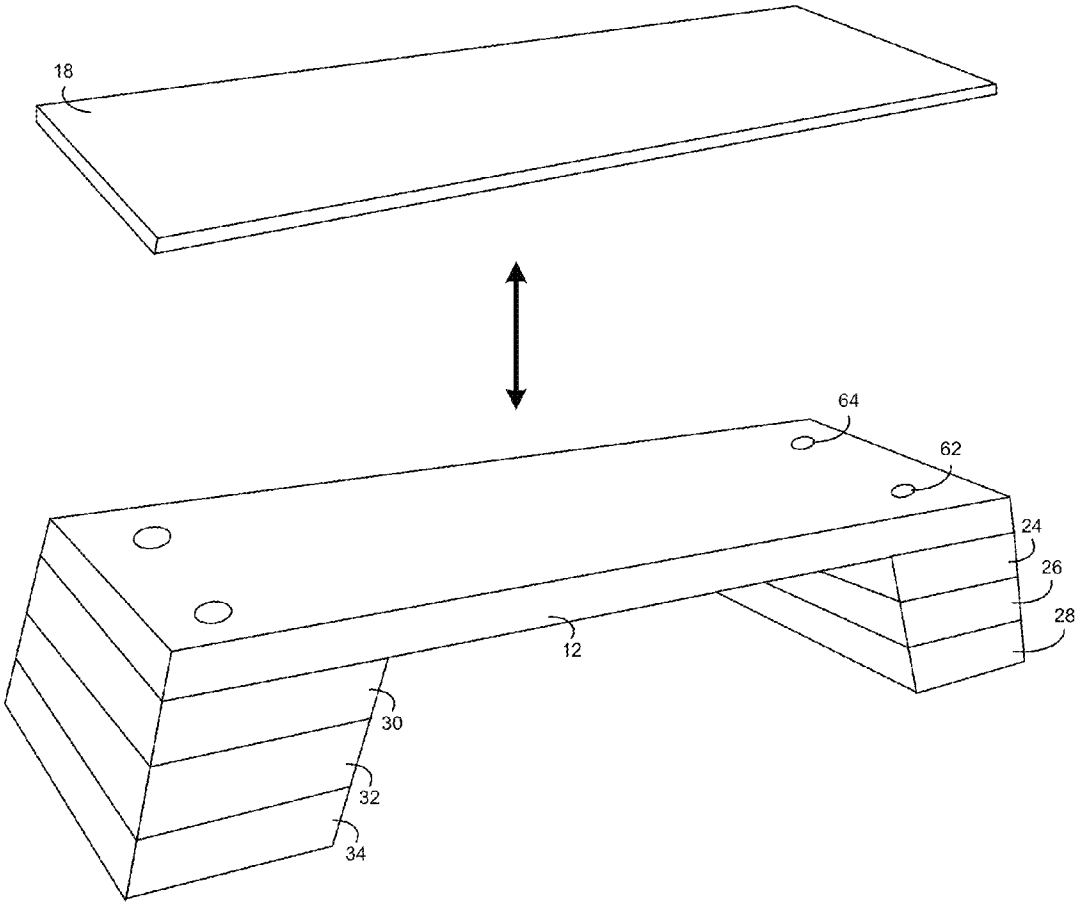
FIG. 3 is a perspective view of an embodiment of the impact absorbing exercise device of FIG. 1.
Figure 4:
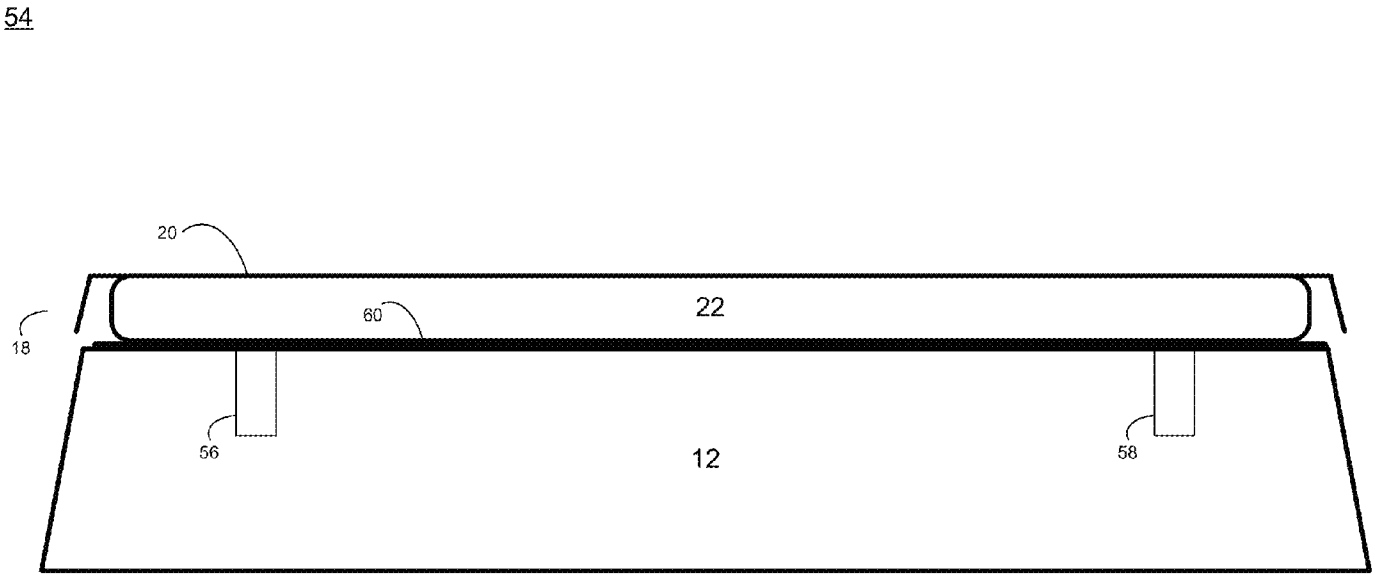
FIG. 4 is a cross-sectional view of the impact absorbing exercise device of FIG. 3.

Referring also to FIGS. 3-4, a first embodiment of releasable attachment system 54 is shown, which may include one or more pin assemblies 56, 58 rigidly affixed to e.g., lower surface 60 of impact absorbing panel 18. Pin assemblies 56, 58 may be configured to releasably engage one or more passages (e.g., passages 62, 64) included within stepping platform 12, thus allowing impact absorbing panel 18 to be releasably attached to upper surface 14 of stepping platform 12. Pin assemblies 56, 58 may be sized to result in an interference fit with e.g., passages 62, 64.

As an alternative to pin assemblies 56, 58 and passages 62, 64, other releasable attachment systems may be utilized and are considered to be within the scope of this disclosure. For example, a hook and loop fastening system (not shown) may be utilized to releasably attach impact absorbing panel 18 to upper surface 14 of stepping platform 12.

Figure 5:
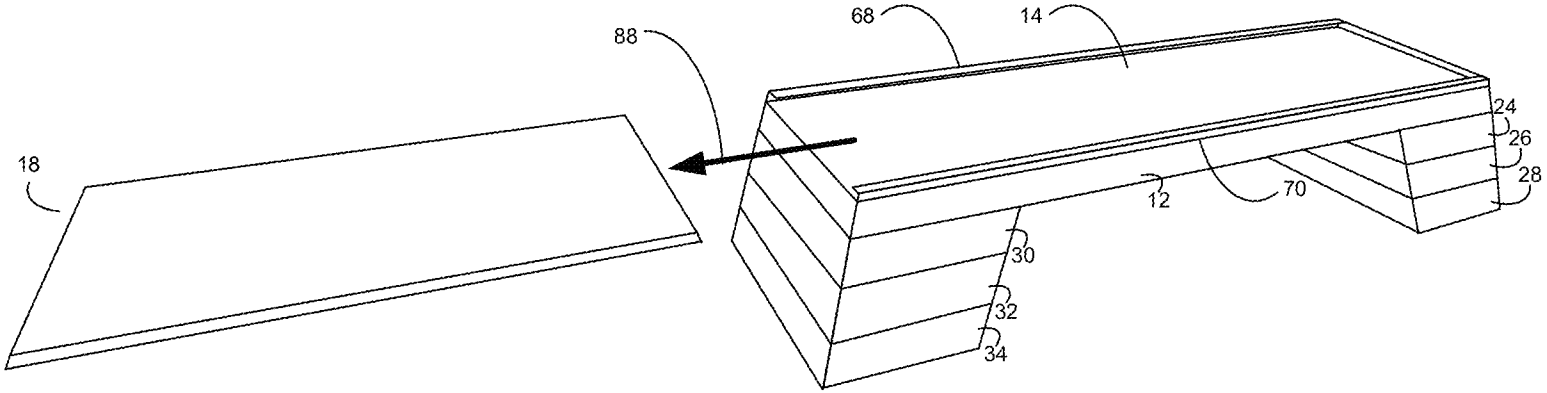
FIG. 5 is a perspective view of an embodiment of the impact absorbing exercise device of FIG. 1.
Figure 6:
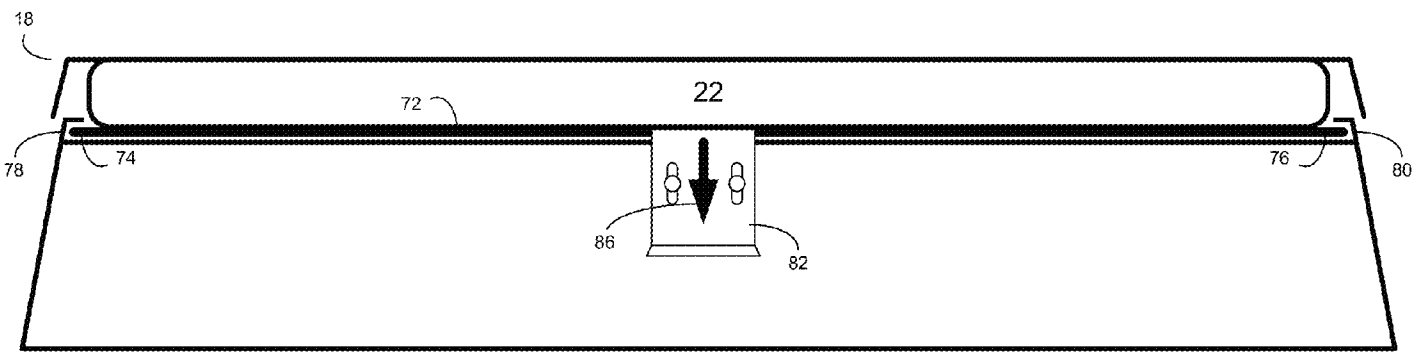
FIG. 6 is a cross-sectional view of the impact absorbing exercise device of FIG. 5.
Figure 7:
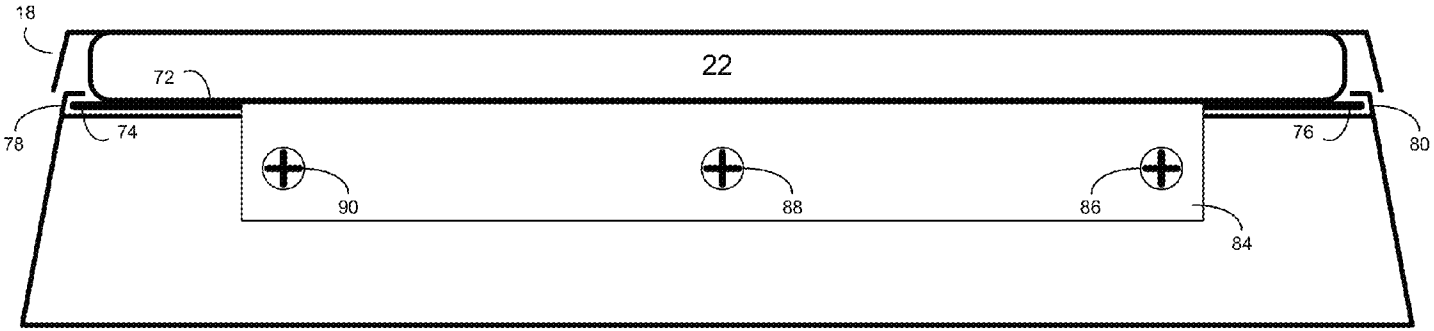
FIG. 7 is a cross-sectional view of the impact absorbing exercise device of FIG. 5.

Referring also to FIGS. 5-7, an alternative embodiment of releasable attachment system 66 is shown, which may include one or more bracket assemblies 68, 70 rigidly affixed to e.g., upper surface 14 of stepping platform 12. Impact absorbing panel 18 may include a lower surface 72 sized so that peripheral edges (e.g., edges 74, 76) of lower surface 72 are received within channels (e.g., channels 78, 80) included within bracket assemblies 68, 70.

Releasable attachment system 66 may include one or more latch assemblies (e.g., latch assemblies 82, 84) configured to releasably attach impact absorbing panel 18 to upper surface 14 of stepping platform 12. Specifically, latch assemblies 82, 84 may be configured to retain the peripheral edges (e.g., edges 74, 76) of lower surface 72 of impact absorbing panel 18 within channels (e.g., channels 78, 80) included within bracket assemblies 68, 70.

In a first example, latch assembly 82 is shown to be a spring loaded latch assembly that is biased by a resilient device (such as a spring; not shown) in a biased upward position. In the event that impact absorbing panel 18 is to be removed from stepping platform 12 (e.g., when it is time to replace impact absorbing panel 18), latch assembly 82 may be biased downward (in the direction of arrow 86), thus allowing impact absorbing panel 18 to be slid (in the direction of arrow 88) and removed from stepping platform 12. To install/reinstall impact absorbing panel 18, the removal process may be reversed.

In a second example, latch assembly 84 is shown to be a rigid latch assembly that is rigidly and releasably attached to stepping platform 12 via one or more fasteners (e.g., screw assemblies 86, 88, 90). In the event that impact absorbing panel 18 is to be removed from stepping platform 12 (e.g., when it is time to replace impact absorbing panel 18), latch assembly 84 may be removed from stepping platform 12 by removing e.g., screw assemblies 86, 88, 90, thus allowing impact absorbing panel 18 to be slid (in the direction of arrow 88) and removed from stepping platform 12. To install/reinstall impact absorbing panel 18, the removal process may be reversed.

A number of implementations have been described. Nevertheless, it will be understood that various modifications may be made. Accordingly, other implementations are within the scope of the following claims.

What is claimed is:

1. An impact absorbing exercise device comprising:

a stepping platform having an upper surface and a lower surface; and a impact absorbing panel configured to be releasably coupled to the upper surface of the stepping platform, the impact absorbing panel including:

a resilient wear surface, an impact absorbing material positioned between the resilient wear surface and the stepping platform;

a releasable attachment system configured to releasably attach the impact absorbing panel to the upper surface of the stepping platform; and one or more riser assemblies releasably coupleable to the stepping platform and configured to elevate the stepping platform above a work surface;

wherein the releasable attachment system includes one or more pin assemblies rigidly affixed to a lower surface of the impact absorbing panel, wherein the one or more pin assemblies are configured to releasably attach the impact absorbing panel to the upper surface of the stepping platform;

wherein the one or more riser assemblies are configured to be in constant contact with the work surface during exercise.

2. The impact absorbing exercise device of claim 1 wherein the resilient wear surface is constructed of a material chosen from the group consisting of: polypropylene, polyethylene, polyvinyl chloride, polycarbonate, acrylic, and acrylonitrile-butadiene-styrene.

3. The impact absorbing exercise device of claim 1 wherein the impact absorbing material is a silicone-based impact absorbing gel.

4. The impact absorbing exercise device of claim 1 wherein the impact absorbing material is an impact absorbing foam.

5. The impact absorbing exercise device of claim 1 wherein the stepping platform is constructed of a material chosen from the group consisting of: polypropylene, polyethylene, polyvinyl chloride, polycarbonate, acrylic, and acrylonitrile-butadiene-styrene.

6. An impact absorbing exercise device comprising:

a stepping platform having an upper surface and a lower surface;

one or more riser assemblies releasably coupleable to the stepping platform and configured to elevate the stepping platform above a work surface; and a impact absorbing panel configured to be releasably coupled to the upper surface of the stepping platform, the impact absorbing panel including:

a resilient wear surface, an impact absorbing material positioned between the resilient wear surface and the stepping platform; and a releasable attachment system configured to releasably attach the impact absorbing panel to the upper surface of the stepping platform;

wherein the releasable attachment system includes one or more pin assemblies rigidly affixed to a lower surface of the impact absorbing panel, wherein the one or more pin assemblies are configured to releasably attach the impact absorbing panel to the upper surface of the stepping platform;

wherein the one or more riser assemblies are configured to be in constant contact with the work surface during exercise;

wherein the impact absorbing material and the resilient wear surface are configured together to allow for a predetermined level of impact absorption.

7. The impact absorbing exercise device of claim 6 wherein the resilient wear surface is constructed of a material chosen from the group consisting of: polypropylene, polyethylene, polyvinyl chloride, polycarbonate, acrylic, and acrylonitrile-butadiene-styrene.

8. The impact absorbing exercise device of claim 6 wherein the impact absorbing material is a silicone-based impact absorbing gel.

9. The impact absorbing exercise device of claim 6 wherein the impact absorbing material is an impact absorbing foam.

10. The impact absorbing exercise device of claim 6 wherein the stepping platform is constructed of a material chosen from the group consisting of: polypropylene, polyethylene, polyvinyl chloride, polycarbonate, acrylic, and acrylonitrile-butadiene-styrene.

* * * * *